United States Patent [19]

Rendina

[11] Patent Number: 4,918,758

[45] Date of Patent: Apr. 24, 1990

[54] CHANGEABLE MESSAGE STRETCH BAND

[76] Inventor: Joseph R. Rendina, 1554 River View St., Monroe, Mich. 48161

[21] Appl. No.: 316,598

[22] Filed: Feb. 27, 1989

Related U.S. Application Data

[63] Continuation of Ser. No. 143,035, Jan. 12, 1988, abandoned.

[51] Int. Cl.[5] ..... A42B 1/24

[52] U.S. Cl. ..... 2/171; 2/199; 2/246; 2/DIG. 6; 2/DIG. 11

[58] Field of Search ..... 2/171, 199, 185 R, 246, 2/DIG. 6, DIG. 11

[56] References Cited

U.S. PATENT DOCUMENTS

| | | | |
|---|---|---|---|
| 792,533 | 6/1905 | Miller | 2/181 |
| 2,783,474 | 3/1957 | Campagna | 2/171 |
| 2,871,485 | 2/1959 | Greco | 2/246 |
| 3,184,758 | 5/1965 | Hirsch | 2/DIG. 11 X |
| 4,047,400 | 9/1977 | Thorneburg | 2/170 X |
| 4,091,766 | 5/1978 | Colliard | 40/586 X |
| 4,264,666 | 4/1981 | Hix | 428/187 |
| 4,277,847 | 7/1981 | Florio | 2/DIG. 11 X |
| 4,462,116 | 7/1984 | Sanzone | 2/170 |
| 4,499,741 | 2/1985 | Harris | 2/DIG. 11 X |
| 4,521,922 | 6/1985 | Mitchell et al. | 2/171 |
| 4,547,903 | 10/1985 | Brown et al. | 2/DIG. 6 X |
| 4,581,271 | 4/1986 | Gordon | 40/586 X |
| 4,611,355 | 9/1986 | Galanto et al. | 2/246 |
| 4,630,317 | 12/1986 | Brown et al. | 2/12 |
| 4,665,566 | 5/1987 | Garrow | 2/171 |
| 4,691,387 | 9/1987 | Lopez | 2/DIG. 6 X |
| 4,776,043 | 10/1988 | Coleman | 2/199 |

OTHER PUBLICATIONS

*Sporting Goods Business,* "Sweat Bands for Head and Wrist", 05-08-72.

*Primary Examiner*—Peter Nerbun
*Attorney, Agent, or Firm*—Robert E. Witt

[57] ABSTRACT

A changeable message stretch band is disclosed which allows the wearer to communicate words and expressions, particularly thoughts and/or feelings, via the use of removably attached graphics, including letters, numerals, designs and the like, in any combination selected by the wearer, whereby the wearer may quickly and easily change the message on the stretch band.

3 Claims, 2 Drawing Sheets

CHANGEABLE MESSAGE STRETCH BAND

This is a continuation of application Ser. No. 07/143,035, filed Jan. 12, 1988.

BACKGROUND OF THE INVENTION

This invention relates to apparel, particularly sports and fashion apparel, which enables the wearer of the article, a stretch band, to provide changeable messages, as an expression of their thoughts and/or feelings.

More specifically, this invention relates to providing means to allow the wearer of apprel to selectively change messages of words, expressions and designs, at will, by enabling the wearer to replace individual letters, numbers, graphics and the like on a specific site of the same apparel, as the moods or feelings or environments of the wearer dictate.

Stretch bands have found particular utility on a person's head and wrists in the past to absorb moisture and perspiration to protect the wearer's eyes and/or wrists, especially when gripping an object such as a racquet or club. Furthermore, stretch bands have been used in the past in a somewhat decorative or fashionable manner by the wearer, even when not participating in a sport or in strenuous activity.

Also, stretchable head bands have been introduced in the past whereby a design is printed on a plain region thereof which maintains the configuration of the design during normal stretching. And, written messages on stretch bands have been employed in the past. However, these prior designs/messages were of a fixed nature on the apparel and they were not capable of being changed at the will of the wearer.

Heretofore, letter characters and designs have been used to convey messages on various garments, but heat sensitive materials have been employed, which renders the resulting word or expression or design in a fixed relation with the garment, not capable of change, by the wearer of that garment. And, prior hereto, hook and loop materials, more commonly referred to as Velcro (registered trademark) have been used on apparel as a means of closure or of fastening structural objects to change the function of the apparel.

Additionally, garments other than stretch bands, such as belts and collars and cuffs and hat liners have had monograms and other elements inserted into openings thereon, and some head bands have employed pockets to receive a message which is seen through a transparent surface affixed thereto. Some head bands have even been adapted to receive visors and caps. These garments and head bands have the limitation of not being able to convey a message of words and expressions which is capable of being changed by the wearer; rather, they convey fixed messages, and thereby find no application to the present invention. Up to the present time, the only means for substantially changing a message on a stretch band or other garment was for the wearer to change the stretch band or garment employing another message.

SUMMARY OF THE INVENTION

The present invention, however, provides a means to facilitate changeable messages on the same apparel, primarily on stretch bands of the type worn on a person's head and wrists, to enable the wearer to express their thoughts and/or feelings depending upon the situation or the environment at a particular time, thus overcoming the above limitations in an easy, quick and neat manner, by employing a fixed area on the apparel to preferentially receive various graphics which are removably attached to the fixed area by the user.

The stretch band of the present invention is preferably fabricated from tubular stretch terry material which is capable of expanding and contracting circumferentially and of absorbing perspiration in addition to being capable of maintaining a fixed area of material, continuous and/or discontinuous; comprising a multiplicity of loops, designed to receive and accommodate various graphics, comprising a plurality of hooks, which graphics are applied to the fixed area and are removed from the fixed area by the user or wearer of the band.

The fixed area of material comprising a plurality of loops, especially when in a continuous form, generally restricts the stretchability of the band associated or juxtaposed with the looped material, thereby the circumferential extension of the looped material along the circumference of the band must be limited to less than the circumference of the band to be periodically interrupted about the circumference of the band, to allow some stretching of the band by the user or wearer to accommodate various sizes.

The interaction of the loops of the material in the fixed area and the hooks of the material for the graphics, cannot alone be used for the desired characteristics possessed by a stretch band, but when the above interacting materials are combined with the stretch band, aesthetic and functional qualities are imparted to the stretch band. This is accomplished by selectively and strategically adhering various configurations and patterns of looped material to the stretch band and by employing graphics, preferably die cut from the hooked material, for removable attachment to the looped material. The looped material, when in discontinuous form, can be strategically positioned about the entire circumference of the stretch band without substantially restricting the stretching qualitites of the stretch band, and yet produce fashionable patterns aesthetically appealing in addition to functioning as receptors for the graphics.

The fixed areas of looped material do not need to accommodate the entire area of the hooked material of the graphics, since the holding power of the interacting loops and hooks is strong and the excess hooks of the graphics will adhere lightly to the material of the stretch band. Such an arrangement of the looped material allows for and provides additional function and aesthetics to the stretch band, although a large fixed area of looped material provides a good background to contrast with the color of the graphics. And, the looped material comprising the fixed area may be the same color as the color of the stretch band, or may be of a different color to provide contrast an aesthetics, in addition to the contrast between the graphics and the fixed areas of looped material.

Preferably, the fixed area of looped material is attached to the outside of the stretch band, by sewing or by adhesive. However, the fixed area of looped material may be inserted within the tubular band and be exposed to receive the graphics by providing various geometric openings on the surface of the band juxtaposed with the looped material.

The graphics comprising a hooked material are preferably die cut for neatness, but they may be cut by hand to provide variations thereto. Any excess graphics not in use on the stretch band may be placed in a container and be carried by the wearer or be stored within the stretch band via at least one slot provided in the inside surface of the stretch band, for easy storage and removal.

One advantage then of present invention is that individual graphics can be selectively attached and removed to a fixed area or fixed areas on the apparel by the user or wearer, to produce changeable messages. Another advantage of the present invention is that the apparel, preferably a stretch band, is provided with a function and fashionable aesthetics without disturbing the other qualities of the apparel, including the ability to absorb perspiration from the user and to stretch for a snug comfortable fit. Another advantage of the present invention is that the fixed area of looped material may be in continuous or discontinuous form and of the same or of a different color than the apparel to provide a site for contrasting colored graphics and to provide various pleasing patterns on the apparel. Another advantage of the present invention is that the fixed area of looped material may be adhered or attached to the stretch band on the outside surface of the stretch band or be inserted within the stretch band accompanied by various cut out areas in the stretch band to expose the looped material, to provide the additional function to the stretch band and to provide additional aesthetics to the stretch band. Yet another advantage of the present invention is that a means is provided to house and store the excess graphics not being used by the wearer or user of the stretch band, for quick accessibility at a future time, without any discomfort to the wearer or user.

The present invention has proven to be well suited to longevity of use with normal wear and cleaning, to be readily adaptable to receive and remove changeable messages desired by the wearer or user, and to be decorative as well as functional in a manner not possible with a regulator commercially available stretch band.

It is therefore an object of the present invention to provide means for the wearer or user of apparel, particularly stretch bands, to exhibit and remove and to change various graphics to produce changeable messages, at a given occasion or site, quickly and neatly.

It is another object of the present invention to eliminate the limitations offered by a fixed, single message.

It is yet another object of the present invention to not materially interfere with the absorbing qualities or with the stretch qualities of the stretch band when providing means for theremovable attachment of various graphics by the wearer or user to produce changeable messages.

It is still another object of the present invention to provide a fixed area of fixed areas on the stretch band, of the same color or of a different color than the stretch band, adapted to removably receive various graphics preferably of a color different than that of the fixed area or fixed areas, which yields aesthetically appealing contrasts.

It is still another object of the present invention to provide means to allow the wearer or user of the stretch band to store and to retrieve excess graphics not being used in a given message on the stretch band.

This invention makes possible the use of commercially available hook and loop material, more commonly referred to as Velcro (registered trademark), in combination with a stretch band, in a manner different than a fastener or closure, by attaching the loop material to a specific site or sites, in a continuous or in a discontinuous manner or pattern respectively, on the stretch band, and by providing preferably precision die cut graphics of the hook material, which are removably attached to the loop material by the wearer or user to produce changeable messages on the stretch band.

According to the present invention, the changeable message stretch band is employed by the wearer or user to exhibit various individual graphics to produce changeable messages to meet specific occasions, while maintaining the other desirable characteristics of the stretch band, especially absorption, stretch and durability, and while providing no discomfrt to the wearer or user.

One essential feature of the present invention is the use of individual graphics of appropriate size for a particular stretch band, to allow the wearer or user to produce the desired removable changeable messages.

Another essential feature of the present invention arises when a continuous, substantially wide length of looped material is used as the fixed area to receive the various graphics, whereby in order to maintain the necessary stretch characteristics of the stretch band to accommodate various sizes and a snug fit, the length of the looped material fixed to the stretch band must not comprise the entire circumference of the stretch band.

DETAILED DESCRIPTION OF THE PREFERRED EMBODIMENT

The changeable message stretch band of this invention finds particular utility in the apparel industry associated with sports, recreation and fashion, which allows the wearer or user of the stretch band a means of expressing thoughts, expressions, feelings and the like, as desired, depending upon a particular issue, occasion or environment of interest to the wearer or user, without uttering a word or in addition to voicing the same.

Specifically, the changeable message stretch band of this invention finds utility by a wearer or user in situations where a message is desired to be communicated, such as at sports events, rallies, political conventions, and the like, to express specific messages, and where flexibility in the message is desired, whereby the wearer or user has the ability to readily change the message on the same stretch band to accommodate or to make a statement for a different situation.

In the construction of the changeable message stretch band, it is important that a first material and a second material be employed in combination with the stretch band, whereby the first material is attached to the stretch band and is communicable with the second material which is removably attached to the first material and comprises various graphics, whereby means is provided to the wearer or user of the stretch band to selectively display and change messages on the same stretch band. It is also important that the stretch qualities of the stretch band be maintained, thereby when a substantially wide, continuous length of first material, having a plurality of loops, defines a fixed area on the stretch band, the length of the first material is restricted to less than the total circumference of the stretch band, since the first material is currently not available as a stretch material. At the same time, the first material must accommodate the second material, comprising individual graphics, by securely holding and by releasing the latter, at the desire of the wearer or user. These requirements indicate the necessity for providing various lengths and/or designs of the first material in continuous lengths, and further allow the use of discontinuous lengths or patterns of first material, to maintain the stretch qualities of the stretch band. Therefore, it becomes crucial that the changeable message stretch band provide a given fixed area to receive the individual graphics, which form the message, without materially interfering with the qualities of the stretch band, particularly stretch and absorption qualities, whereby the given fixed area requires sufficient size and/or distribution to releasably hold the graphics, whether the given fixed area be a continuous length of a discontinuous arrangement or pattern.

Figure 1:
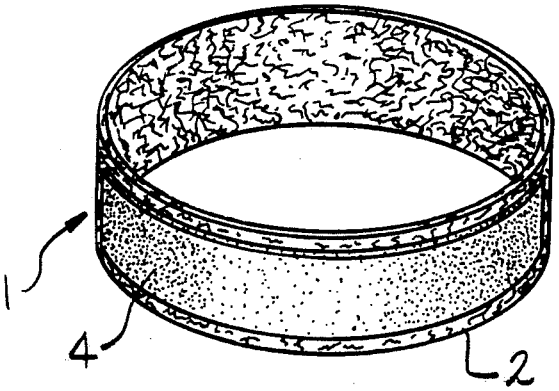
FIG. 1 is a front perspective view of the invention.
Figure 2:
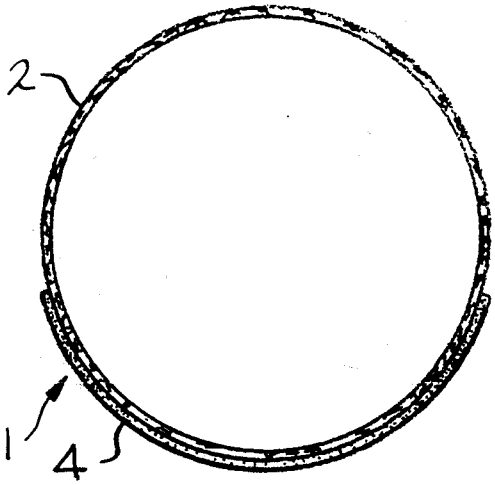
FIG. 2 is a plan view of the invention.

Referring to FIGS. 1 and 2, the changeable message stretch band 1 is shown as a circumferential, tubular unit 2 comprising a stretch material, preferably a stretchable terry cloth material, and further comprising a first material 4 attached thereto. The stretch band 1 is not limited to any particular length or width, but is generally of dimensions to be comfortably worn about the head and wrists and other extremities of the wearer or user. A tubular unit is preferred, but is not mandatory, and any wicking material may be employed which possesses stretch and absorption characteristics.

Figure 3:
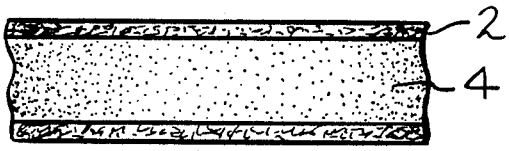
FIG. 3 is a fragmentary portion of a front view of the invention.
Figure 5:
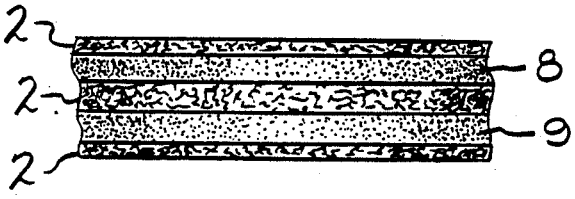
FIG. 5 is a fragmentary portion of a front view of an alternate embodiment of the invention.

The first material 4, referring to FIGS. 1, 2 and 3, is shown as a looped material, attached to the tubular unit 2, and is preferably of a width slightly less than the width of tubular unit 2, and is preferably of a length of approximately one-half the circumference of the tubular unit 2. The looped material is generally available commercially as a flexible, non-stretchable material, and thereby when it is attached to the tubular unit 2, such as by sewing, or adhesives, or other known means, the stretch properties of the tubular unit are substantially restricted. When, however, the length of the looped first material 4 is approximately one-half the circumference of the tubular unit 2, sufficient stretch properties remain, and the length of the first material 4 is quite substantial to accommodate most messages. Lengths of the first material 4 of more or less than the circumference of the tubular unit 2 are also desirable when the stretch characteristics of the tubular unit 2 are such as to warrant the same. The width of a continuous length of first material 4 has no restrictions, and can be the same width as the tubular unit or can be of a narrow width, as shown in FIG. 5 where the first material 8, 9 comprises two narrow strips of continuous length.

The looped first material is known to possess superior holding characteristics especially when it interacts with a hooked second material, and thereby the width, configuration and placement of the first material may be varied to reflect various aesthetic characteristics. Referring to FIG. 3, the first material 4 is shown as a wide continuous length attached to the tubular unit 2, and in FIG. 5, the first material 8, 9 is shown as narrow continuous lengths attached to the tubular unit 2.

Figure 8:
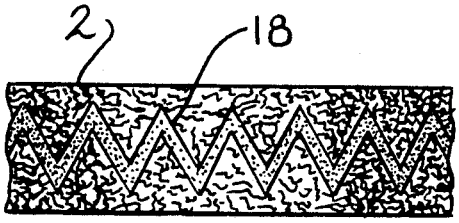
FIG. 8 is a fragmentary portion of a front view of an alternate embodiment of the invention.
Figure 9:
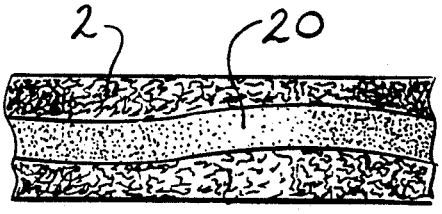
FIG. 9 is a fragmentary portion of a front view of an alternate embodiment of the invention.

The continuous lengths of first material may also comprise design characteristics to impart aesthetics to the tubular stretch band. Referring to FIG. 8, the looped first material 18 is shown as a wavy configuration comprising a narrow continuous length attached to the tubular unit 2, and FIG. 9 shows the looped first material 20 as a serpentine narrow continuous length attached to the tubular unit 2. These configurations are less restrictive regarding the stretch characteristics of the stretch band and they provide the latter with the requisite function as well as aesthetics, especially when the entire area available for interacting the second material is not utilized by the wearer or user of the stretch band.

The looped first material also functions well as discontinuous lengths when it is attached to the stretch band, to provide the requisite function of receiving the hooked second material, and as discontinuous lengths, the looped first material does not substantially restrict the stretch characteristics of the stretch band, whereby the entire circumference of the stretch band is available for attachment of the discontinuous lengths (not shown). The use of discontinuous lengths about the entire circumference of the stretch band provides more functional area to receive a changeable message by removably attaching the graphics comprising the hooked second material thereto, whereby the wearer or user of the changeable message stretch band has more flexibility, for example, a separate or different message may be applied to the front and to the back of the stretch band.

Figure 4:
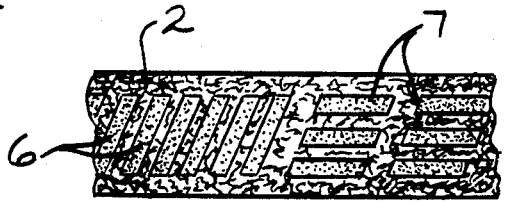
FIG. 4 is a fragmentary portion of a front view of an alternate embodiment of the invention.
Figure 6:
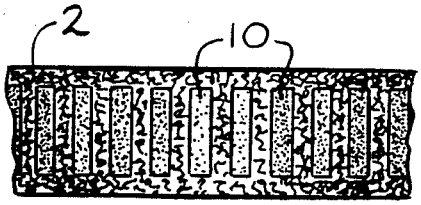
FIG. 6 is a fragmentary portion of a front view of an alternate embodiment of the invention.
Figure 7:
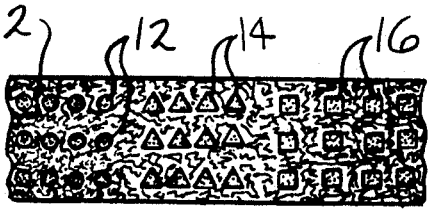
FIG. 7 is a fragmentary portion of a front view of an alternate embodiment of the invention.

Referring to FIG. 4, discontinuous lengths of looped first material 6, 7 are shown attached to the tubular unit 2, in a pattern or arrangement which is sufficient to securely hold the hooked second material and release the latter, and which is aesthetically pleasing when not fully covered by the graphics comprising the hooked second material. Referring to FIG. 6, discontinuous lengths of looped first material 10 are shown attached to the tubular unit 2 in yet another pattern or arrangement which allows the tubular stretch band to be stretched without substantial restriction. Referring to FIG. 7, discontinuous lengths of looped first material 12, 14, 16 are shown as various geometric shapes, including circles, triangles and squares respectively, attached to the tubular unit 2 in a representative pattern or arrangement, which allows the tubular stretch band to be stretched to substantially the same limits as an unaltered stretch band.

The color of the looped first material may be the same as the stretch band, or may approximate the color of the stretch band, or may be different then the color of the stretch band, to provide color blends and/or contrasts, in addition to its function of receiving and releasing the hooked second material.

The hooked second material is cut or formed into various graphics, including alphabet letters, numerals, designs, symbols, and the like, which are preferably of a color in contrast with the color of the looped first material, whereby when the graphics are removably attached by the wearer or user to the stretch band, a changeable message appears which is readily visible. The graphics are generally intended to reside within the confines of the width and length of the tubular stretch band, but the tenacious nature of the interaction between the loop and hook material, i.e. the first and second materials respectively, more commonly referred to as Velcro and Velstik (registered tradenames) allows the wearer or user of the stretch band to extend the graphics beyond the dimensions of the stretch band, to create more available area for a changeable message, from top to bottom and from side to side (not shown), and to create a fashionable or a random display of the changeable message.

Figure 11:
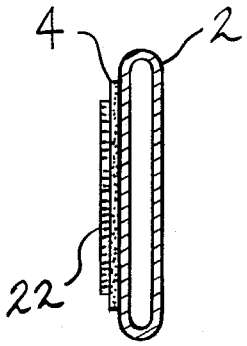
FIG. 11 is a sectional view along line 11—11 in FIG. 10.
Figure 10:
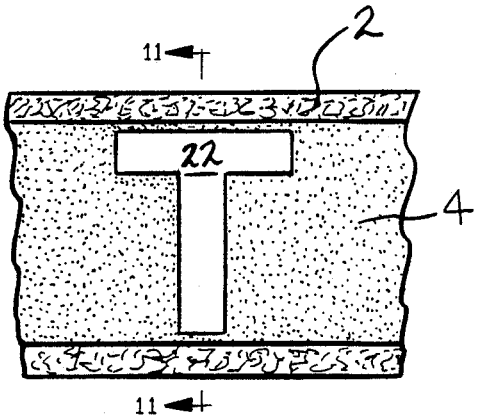
FIG. 10 is a fragmentary portion of an enlarged front view of the invention.

Referring to FIG. 10, the graphic 22 comprising the hooked second material, is shown neatly arranged and attached to the looped first material 4, which is attached to the tubular unit 2, to yield a changeable message stretch band. Referring to FIG. 11, which is a sectional view of the stretch band along line 11—11 in FIG. 10, the tubular unit 2 is more clearly shown, with the looped first material 4 attached thereto, and with the graphic 22, comprising the hooked second material, being attached to the looped first material 4. The graphic 22 is readily removed by the wearer or user from the looped first material 4 by peeling the former from the latter.

The graphic 22, depicted in FIGS. 10 and 11 as the letter "T", is represented as having its entire hooked surface engaging substantially the width of the looped first material 4. When additional graphics are placed by the wearer or user of the stretch band to engage the looped first material to form a message (not shown), the arrangement of the graphics may be changed, immediately to enhance or to correct a word or may be changed at a latter time to form another message. When the entire hooked surface of the graphics is engaging the looped first material, the strongest bonding relationship results.

Figure 12:
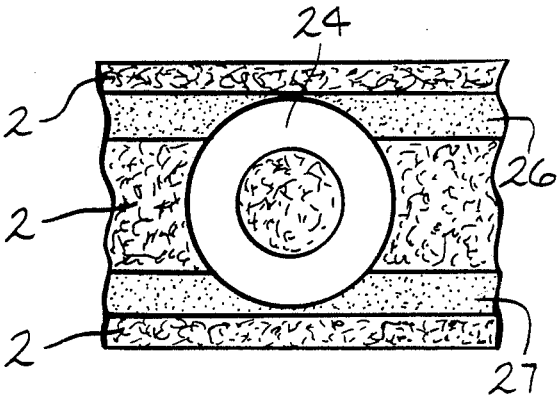
FIG. 12 is a fragmentary portion of an enlarged front view of an alternate embodiment of the invention.

However, the surface of the stretch band, usually comprising a terry cloth material, is also capable of lightly holding the hooke surface of the graphics to produce a neat relationship and to allow various patterns or arrangements of the looped first material to be attached to the stretch band. Referring to FIG. 12, the graphic 24, depicted as the letter "O", is represented as having portions of its hooked surface engaging portions of narrow continuous lengths of the looped first material 26, 27 and as having the remaining portion of its hooked surface engaging the terry cloth fabric of the tubular unit 2, to yield a neat placement of the graphic 24 on the tubular unit 2. By looking beyond the width of the stretch band, the wearer or user can removably attach graphics individually, to either the looped first material 26, or the looped first material 27 and extend the number of graphics (not shown) beyond the dimensions of the stretch band, to create longer messages and/or to create distinctive messages.

The looped first material is generally attached externally to the stretch band's outer surface, as shown in FIGS. 1–12. However, there are occasions when it is desirous to insert the looped first material within the tubular stretch band and to provide at least one opening or a plurality of openings, of various geometric shapes to expose the loops of the looped first material, whereby the latter can receive and removably engage graphics comprising a hooked second material, to produce the requisite function and to produce a different aesthetic appeal to the changeable message stretch band.

Figure 13:
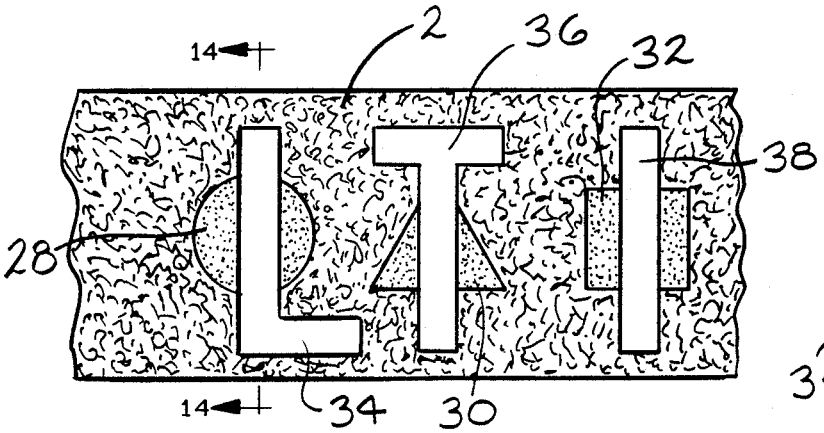
FIG. 13 is a fragmentary portion of an enlarged front view of an alternate embodiment of the invention.
Figure 14:
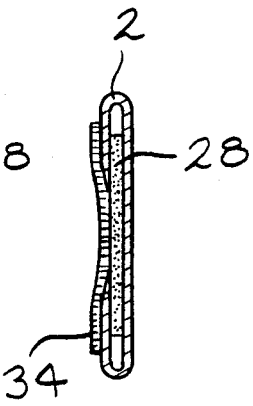
FIG. 14 is a sectional view along line 14—14 in FIG. 13.

Referring to FIG. 13, graphics 34, 36, 38, depicted as the letters "L", "T", "I" respectively, are represented as having portions of their hooked surface engaging portions of the looped first materials, 28, 30, 32, respectively, and as having portions of their hooked surface engaging the terry cloth fabric of the tubular unit 2. Referring to FIG. 14, which is a sectional view of the stretch band along line 14—14 in FIG. 13, the tubular unit 2 is more clearly shown, with the looped first material 28 inserted therein, and with the graphic 34 somewhat depressed to engage the looped first material 28, and with the graphic's remaining hooked surface engaging the terry cloth fabric of the tubular unit 2.

During the construction of the changeable message stretch band, comprising having the looped first material inserted within the tubular structure, the looped first material may be attached to one or both of the interior surfaces of the tubular structure with sewing and/or adhesives and the like, or it may be simply inserted within the tubular structure, and possess sufficient stability by the confines of the tubular structure, to properly function.

It has been demonstrated that reversing the function of the first and second materials is possible and at times preferred, especially when constructing a changeable message stretch band as shown in FIGS. 13 and 14, but not limited to this construction. That is, the material comprising the graphics may be fabricated from the looped material and the material to receive the graphics may be the hooked material, whereby the latter engages one of the interior surfaces of the tubular band, for added stability.

When the wearer or user of the changeable message stretch band desires to change the message at a given site, to address a specific occasion or to meet changing developments, it is desirable that the wearer or user carry excess graphics. One way is to insert unused graphics into a flat container and to carry the container within the stretch band, for easy storage and retrieval.

Figure 15:
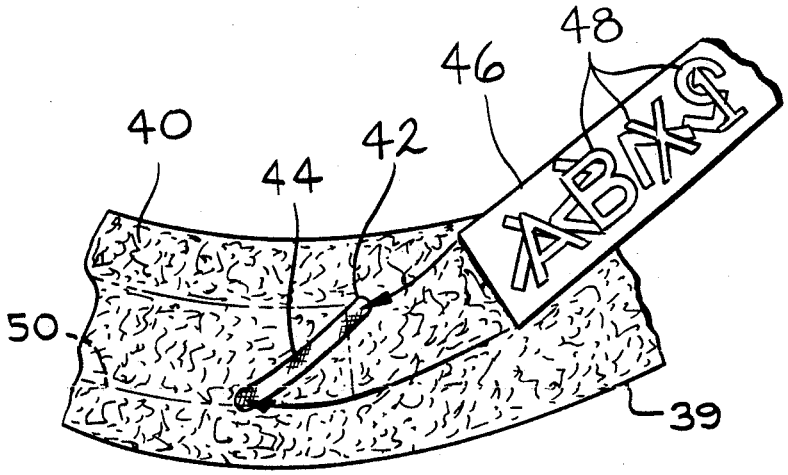
FIG. 15 is a fragmentary portion of an enlarged inside surface of an alternate embodiment of the invention.

Referring to FIG. 15, an inside surface 40 of a stretch band 39, is provided with a slot 42 or similar opening, thereby exposing the interior 44 of the stretch band 39, for the receipt and retrieval of a container 46, preferably flat, comprising a plurality of various graphics 48, shown in the inserted position 50, thus giving the wearer or user instant flexibility to change messages without any discomfort when wearing or using the stretch band.

Modifications of the disclosed article may be resorted to without departing from the spirit and scope of the appended claims.

I claim:

1. A tubular stretch band comprising a preferred inside surface and a preferred outside surface and interior surfaces, and further comprising at least one opening in the said outside surface, and further comprising a first material, having a plurality of loops, in communication with the said interior surfaces and the said opening, whereby the said loops on the said first material are exposed within the said opening to preferentially receive at least one graphic comprising a second material, having a plurality of hooks, wherein said second material is removably attached to the said first material by the user of the said band to enable the user of the said band to communicate changeable messages.

2. The tubular stretch band as claimed in claim 1, further comprising a plurality of openings formed from various geometric shapes, including circles, squares, triangles and rectangles, present in the said outside surface to yield a plurality of sites of exposed said first material available to removably receive said graphic at each said site.

3. The tubular stretch band as claimed in claim 2, wherein the said plurality of openings in the said outside surface defines an area of approximately one-half the circumference of the said bond.

* * * * *